United States Patent [19]

Clayman et al.

[11] 4,404,702

[45] Sep. 20, 1983

[54] SHANKED INNERSOLE CONSTRUCTION

[75] Inventors: John M. Clayman, Salem; Norman Weiner, Lexington, both of Mass.

[73] Assignee: P. Clayman & Sons, Inc., Salem, Mass.

[21] Appl. No.: 239,345

[22] Filed: Mar. 2, 1981

[51] Int. Cl.[3] ..... A43B 13/41; A43D 31/00

[52] U.S. Cl. ..... 12/146 S; 36/44; 36/76 C

[58] Field of Search ..... 12/146 S, 146 B; 36/76 C, 76 R, 43, 44

[56] References Cited

U.S. PATENT DOCUMENTS 2,391,789 12/1945 Lumbard ..... 12/146 S
2,534,462 12/1950 Lumbard ..... 36/44 X

FOREIGN PATENT DOCUMENTS 2101444 8/1972 Fed. Rep. of Germany .... 12/146 B
2644712 12/1977 Fed. Rep. of Germany .... 12/146 S
1009062 1/1965 United Kingdom ..... 12/146 B

*Primary Examiner*—James Kee Chi
*Attorney, Agent, or Firm*—Edward F. Perlman

[57] ABSTRACT

A shanked innersole with laminated construction having a rigid street side layer, shank attached to foot side surface of the street side layer, shank board layer extending from heel to ball of innersole and a flexible layer attached to rigid street side and shank board thereby sandwiching the shank board between the top and street side layers so that only the shank attaching means are exposed on one side of the innersole construction.

1 Claim, 5 Drawing Figures

SHANKED INNERSOLE CONSTRUCTION

BACKGROUND OF THE INVENTION

This invention relates to a shanked innersole construction which is used for inner soles for boots and the like.

There are presently two types of shanked innersoles used by manufacturers of shoes. Each of these shanked innersoles have at least one layer, a relatively rigid layer which holds the shape of the innersole after it is molded. The shank is normally attached to the rigid layer. The shanked and molded innersole is found in footwear such as boots where the extra rigidity provided by the shank is desired to create a sturdier boot and is more comfortable to wear.

The first kind of shanked innersole referred to above is known in the industry as the "continental innersole." It is made by riveting a shank to a piece of tuck material or shank board which has been cut to match the back part of the rigid portion of the innersole. The front edge of the tuck is skived and the tuck and shank construction is attached to the lower face of the innersole by a suitable adhesive. In another step, on the foot side surface of the innersole a sock lining can be attached to the foot side surface of the rigid material. The tuck is skived in order to create an innersole with a relatively smooth face. The relative smoothness of the lower face is important because of the way in which a shoe upper is attached to the innersole prior to lasting the shoe. The edge of the upper is cemented to the street side face of the innersole and the cement is applied through an extruder which travels along the edge of the innersole's street side face. Any discontinuity on the street side face interferes with the travel of the extruder. Thus, to reduce the number of "cripples" or unuseable pieces, the speed of the gun's travel must be reduced so as not to get hung up on the joint between the tuck and rigid material. Thus the fabrication process becomes expensive and time consuming due to the slow speed of the cement extruder.

The second type of innersole referred to above has the following construction. A channel is milled out of the rigid layer on the street side of the innersole construction by removing a portion of the rigid material. A shank is placed in this channel and attached to the innersole. This construction has a major drawback in that the groove has been created by removing some of the rigid material along the innersoles longitudinal axis. This results in an innersole with substantially reduced torsional rigidity. Thus, the innersole can twist with the result that it does not provide the support necessary in various types of footwear.

SUMMARY OF THE INVENTION

In accordance with the present invention, a shanked innersole construction has been designed in which the innersole's constituent materials have been laminated together for at least a portion of the innersole before attaching the shank to the inner surface of the street side rigid layer.

The innersole of the present invention contains a shank positioned between a street side rigid layer and a layer of tuck material. The layer of tuck material extends from the heel portion to the ball portion of the innersole. The shank is inserted between these layers by peeling the street side rigid layer from the tuck material so as to form a pocket for the steel shank. Although the layers of material in the forepart and toe portion of the innersole are laminated, the material layers in the heel portion are only cemented along a relatively thin strip. As a result, the heel portion is easily separated for shank insertion. After the shank is attached by riveting it to the street side rigid layer, the tuck material is then cemented to the street side rigid layer.

This configuration and method of fabrication provide the shoe manufacturer with an accurately aligned shanked innersole without the need for expensive labor intensive fabrication. Further, the innersole has good torsional rigidity since the shank was inserted without the need to mill or remove rigid board material. Still further, the lower surface of street side rigid layer is smooth and thus capable of accomodating the movement of the cement extruder at more efficient cementing speeds.

Another object of the present invention is to provide a shanked innersole which may be constructed from a single piece of composite, pre-cut innersole material.

Another object of the present invention is to provide a shanked innersole having a smooth street side face.

Another object of the present invention is to provide a shanked innersole in which the shank is attached in a manner which does not reduce the innersoles' overall rigidity.

Yet another object of the present invention is to provide a shanked innersole which is made with the fewest possible steps.

BRIEF DESCRIPTION OF THE DRAWINGS

The foregoing objects and advantages of the present invention will be more clearly understood when considered in conjunction with the accompanying drawings which.

DETAILED DESCRIPTION OF THE INVENTION

Figure 1:
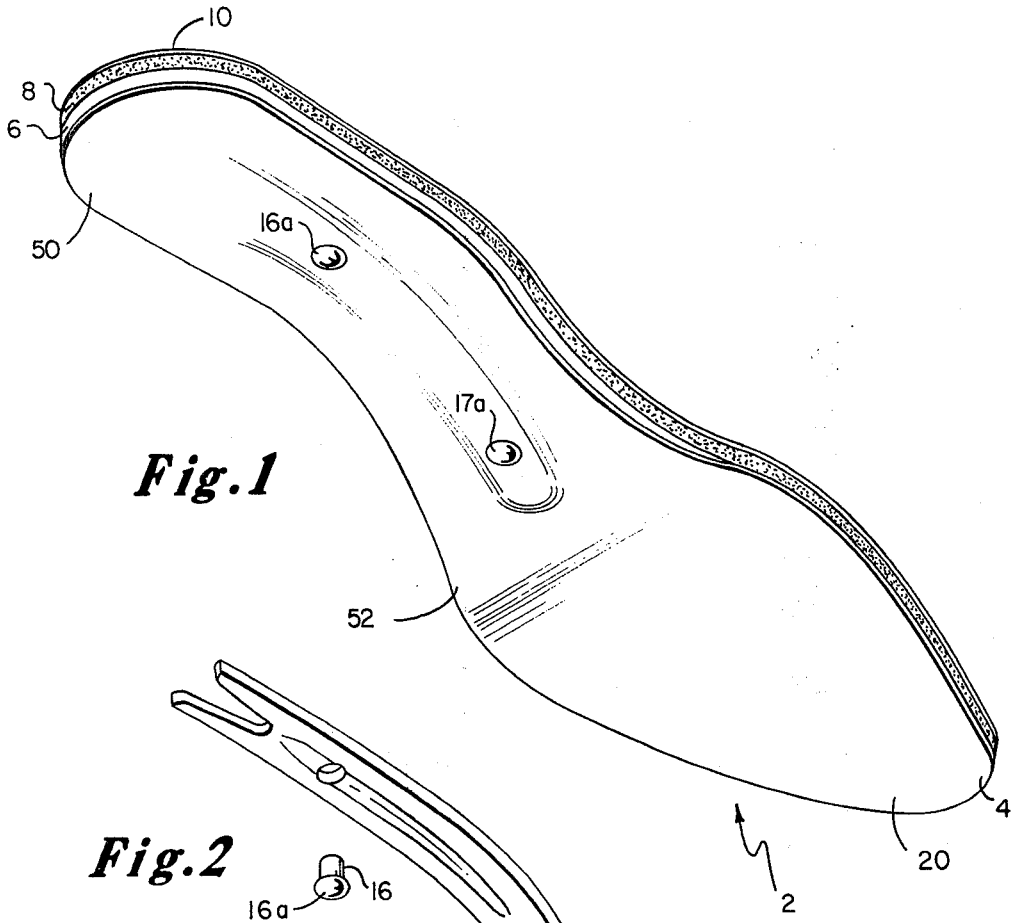
FIG. 1 is a perspective view of a finished innersole of the present invention.
Figure 2:
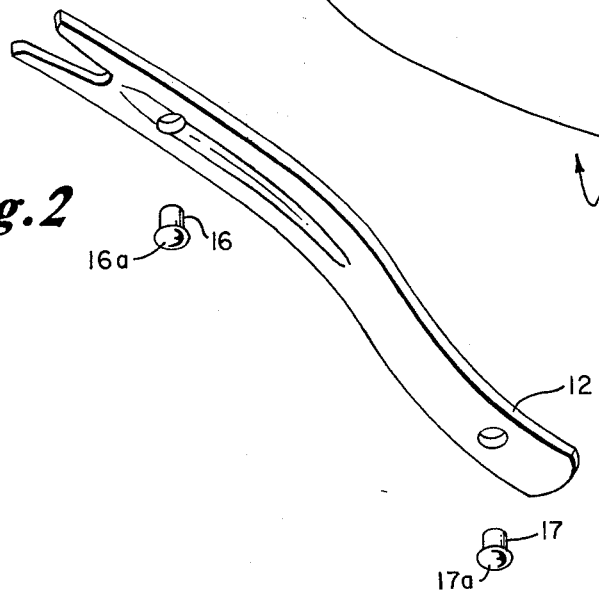
FIG. 2 is a perspective view of a shank and rivets.
Figure 4:
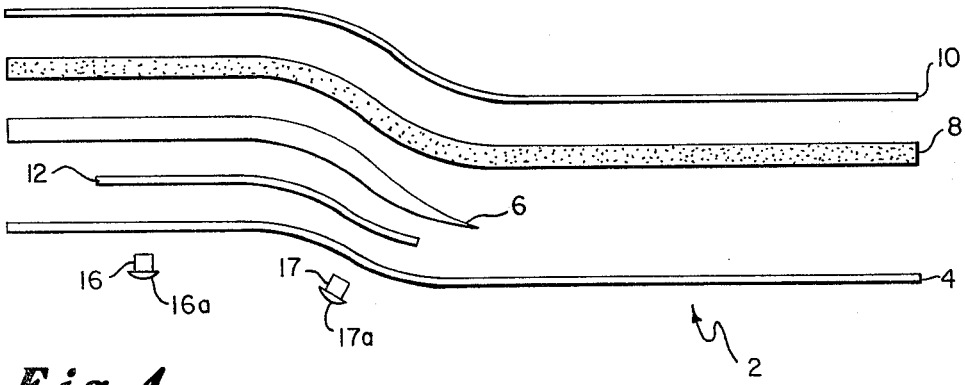
FIG. 4 is an exploded view of a finished innersole.

A shanked innersole assembly 2 of the present invention is shown in FIG. 1 represents the final molded piece ready for use by a shoe manufacturer. It consists of four layers of material bonded together; a rigid street side layer 4, a second rigid layer 6 extending from the ball to the heel of layer 4, a sponge 8 positioned above layer 6, and a top layer or sock liner 10 which can be made from any number of desired sock lining materials. Sponge 8 and sock layer 10 can, if desired, be replaced by a single overlay layer of material. A shank 12 which can be seen in FIG. 2 is riveted to the foot side surface of the street side layer 4 by a pair of capped-head rivets 16, 17 or other types of attachment means. These rivets 16, 17 pierce street side layer 4 such that the rivet heads 16A, 17A remain visible on the street side surface 20 of the finished shanked innersole assembly 2.

Figure 3A:
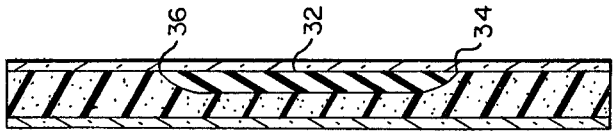
FIG. 3A is a cross-sectional view taken along line 3—3 of FIG. 3.
Figure 3:
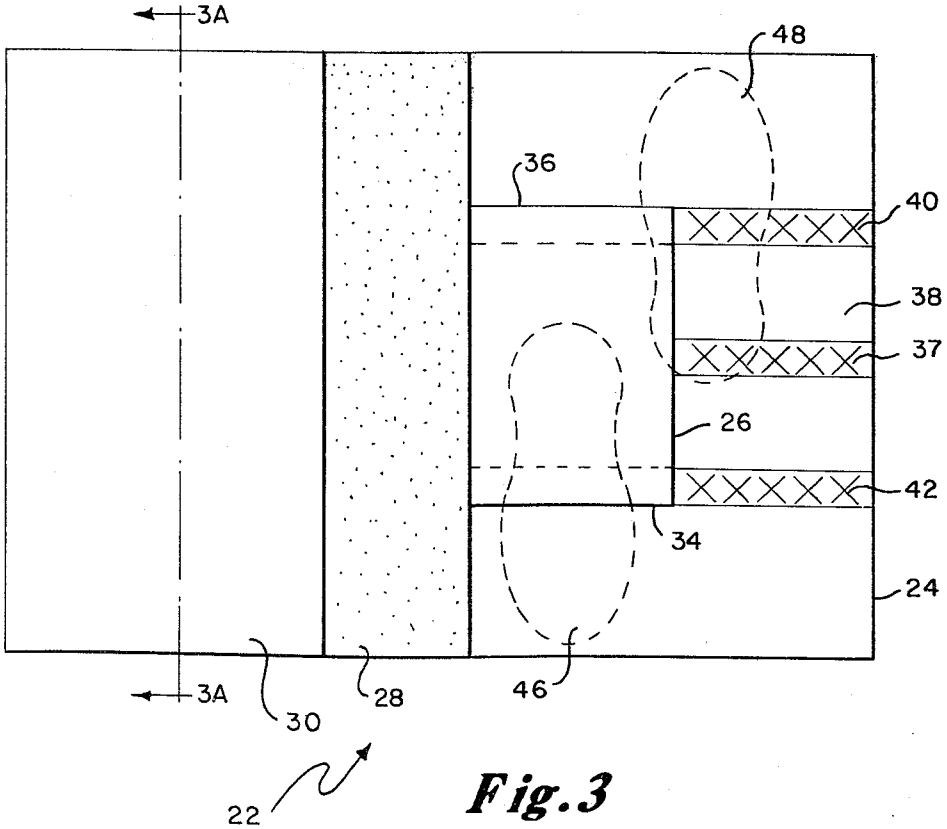
FIG. 3 is an innersole strip with portions of particular layers removed.

The fabrication of innersole assembly 2 is initiated from innersole strip 22 as shown in FIG. 3. The innersole strip 22 generally comprises four layers. A rigid street side or street side layer 24 is normally a latex impregnated fiber board similar to TEXON GRADE 437 having a thickness of approximately 1/16th of an inch. A tuck layer 26 is above the street side layer and normally extends from the ball portion to the heel portion of the innersole. The tuck material is a fiber board which is generally made from recycled materials and similar to Colonial Fiber's product designated as 080TBS. Layer 28 is normally a ⅛th of an inch thick layer of sponge. The sponge material is similar to #4116 KUSHION SPONGE as manufactured by Griswold Company. Top layer 30, the layer adjacent to the foot in a finished shoe, may be any one of a number of sock lining materials of the shoe manufacturers choosing such as #201 PORON. As can be appreciated by those skilled in the art many other materials may be used to provide the strength and flexibility requirements of the innersole 2.

The four layers of innersole strip 22 as described above are sited and joined together in the following manner. The latex impregnated fiber board 24 is cut into sheets approximately 41 inches long by 16 to 18 inches wide depending upon the shoe size in which the finished innersole is to be used. A sheet of tuck material 26 approximately 41 inches long by 7 inches wide is skived along surfaces 32 of edges 34, 36. A coat of a latex adhesive 37 is applied to surface 38 opposite the skived surfaces and to fiber board 26 and lines 40, 42 of adhesive are applied along opposing faces 32 and 38 such that when the tuck is positioned along the longitudinal axis of the fiber board strip, the opposing coats of latex match and provide a double coating of adhesive to hold the two layers together. Layers 28 and 30 which have already been laminated and cut into strips approximately 41 inches long by 18 inches wide are then cemented to the tuck/fiber board laminate to assemble completed innersole strip 22. Innersole blanks 46 are diecut from the innersole strip 22. Broken lines 48 indicate how the die cuts may interlock to reduce the amount of material that is wasted.

At this point the innersole blank 46 consists of a shaped piece having its four layers joined in such a way as to provide access for shank insertion. Therefore, to complete fabrication, the shank is inserted and the entire innersole cemented and molded as described hereinbelow. It should be noted that no layers need to be added or removed and that the different layers will always fit together properly because they were laminated prior to being diecut from innersole strip 22.

The rigid layer 4 and tuck 6 are now joined at the heel by a narrow strip of latex cement. They are easily separated and the shank 12 inserted therebetween. The shank 12 is positioned and riveted to the rigid layer 4 using capped-head rivets 16, 17 for added strength. Cementing the rigid layer and tuck by hand along the heel 50 and ball 52, curing the cement for approximately five minutes and closing is all that remains to prepare the shanked innersole 2 for molding. Hydraulic or other suitable molding means molds shanked innersole 2 from approximately 1 to 10 tons and gives it the desired contour to fit the last as shown in FIG. 1. The shanked innersole 2 is complete except for optional bevelling along an edge of heel 50 which may be specified by some shoe manufacturers.

As can be seen from the foregoing description, the present invention provides a shanked innersole complete with the desired sock lining with smooth lower surface without requiring the removal of any of the stiffening material therefrom. Furthermore the finished, shanked innersoles of the present invention are never disjointed, as the individual layers are fit together before innersole strip 22 is cut.

It will be appreciated that variations in the dimensions and materials disclosed above for the present invention may occur to those skilled in the art. For certain applications, a sock liner or sponge layer is not needed or used. All such variations which come within the spirit and teachings of this disclosure are intended to be covered by the following claims.

What we claim and desire to secure by Letters Patent of the United States is:

1. A method for fabricating a shanked innersole comprising the steps of:

providing a sheet of street side layer material of sufficient length and width that a plurality of innersole blanks may be cut therefrom;

lapping said sheet of street side layer material with a sheet of tuck material narrower in at least one dimension than said sheet of street side layer material, said tuck material sheet being skived along at least one edge;

laminating said street side layer material and said tuck material together by application of adhesive therebetween;

lapping the tuck layer side of said laminate with at least one sheet of sponge material;

cutting through said sponge material and said laminate with dies to form a plurality of innersole blanks in a pattern such that a toe portion of each blank contains no tuck material while a heel portion of each blank includes tuck material, with a skived edge of said tuck material being disposed intermediate said toe and heel portions;

separating tuck material layer and said street side material layer at the heel of each blank;

inserting therebetween a metallic shank stiffening strip having a perforation adjacent each of its ends;

fastening a rivet through said street side material and through of each of said perforations;

cementing said tuck material layer and said street side material layer together again; and molding said innersole blank to conform to the shape of said metallic shank stiffener and the desired shoe contour.

* * * * *